US005555854A

United States Patent [19]

Huemer et al.

[11] Patent Number: 5,555,854

[45] Date of Patent: Sep. 17, 1996

[54] COOLING SYSTEM FOR AN INTERNAL-COMBUSTION ENGINE OF A MOTOR VEHICLE COMPRISING A THERMOSTATIC VALVE WHICH CONTAINS AN ELECTRICALLY HEATABLE EXPANSION ELEMENT

[75] Inventors: Gerhart Huemer, Neukeferloh; Heinz Lemberger, Unterföhring; Peter Leu, Denkendorf, all of Germany

[73] Assignees: Behr-Thomson Dehnstoffregler GmbH, Kornwestheim; Bayerische Motoren Werke AG, Munich, both of Germany

[21] Appl. No.: 376,560

[22] Filed: Jan. 20, 1995

[30] Foreign Application Priority Data

Jan. 20, 1994 [DE] Germany ..... 44 01 620.4

[51] Int. Cl.[6] ..... F01P 7/14

[52] U.S. Cl. ..... 123/41.1

[58] Field of Search ..... 123/41.1, 41.08

[56] References Cited

U.S. PATENT DOCUMENTS 2,816,711 12/1957 Woods ..... 236/34

FOREIGN PATENT DOCUMENTS

0557113A3 8/1993 European Pat. Off. .

3018682C2 11/1980 Germany .

3315308C2 10/1984 Germany .

3315308A1 10/1984 Germany .

3347002C1 5/1985 Germany .

3705232A1 9/1988 Germany .

OTHER PUBLICATIONS

European Search Report May 12, 1995 Europe.

Patent Abstracts of Japan, vol. 12, No. 374 (M–749) 6 Oct. 1988 and JPA63124 821 (Mazda Motor) 28 May 1988.

Germ. Sear. Rpt. Aug. 23, 1994 Germany.

*Primary Examiner*—Noah P. Kamen

[57] ABSTRACT

In the case of a cooling system for an internal-combustion engine of a motor vehicle comprising a radiator and a thermostatic valve by means of which the temperature of the coolant can be controlled in a warm-up operation, a mixed operation and a radiator operation. The thermostatic valve containing an expansion element can be electrically heated for reducing the coolant temperature, the expansion element being designed such that the coolant temperature is controlled without any heating of the expansion element in the warm-up operation and/or the mixed operation to an upper operating limit temperature. In addition, a temperature switch is provided which, as a function of the coolant temperature detected at the or near the radiator outlet, releases the heating of the expansion element as required in order to shift the method of operation of the cooling system toward the radiator operation.

4 Claims, 2 Drawing Sheets

COOLING SYSTEM FOR AN INTERNAL-COMBUSTION ENGINE OF A MOTOR VEHICLE COMPRISING A THERMOSTATIC VALVE WHICH CONTAINS AN ELECTRICALLY HEATABLE EXPANSION ELEMENT

BACKGROUND AND SUMMARY OF THE INVENTION

This invention relates to a cooling system for an internal-combustion engine of a motor vehicle comprising a radiator and a thermostatic valve by means of which the temperature of the coolant can be controlled in a warm-up operation, a mixed operation and a radiator operation, the thermostatic valve containing an expansion element which can be electrically heated for reducing the coolant temperature.

In this case, the thermostatic valve controls the flow of the coolant between the internal-combustion engine and the radiator in such a manner that, during the warm-up operation, the coolant coming from the internal-combustion engine flows essentially while by-passing the radiator through a short circuit back to the internal-combustion engine, in that, during the mixed operation, the coolant coming from the internal-combustion engine flows partially through the radiator and partially through the short circuit back to the internal-combustion engine, and in that, during the radiator operation, the coolant coming from the internal-combustion engine flows essentially through the radiator back to the internal-combustion engine.

The electric heating of the expansion element is used for enlarging the opening cross-section toward the radiator in comparison to an opening cross-section caused by the temperature of the coolant in the area of the thermostatic valve.

A cooling system of the above-noted general type is known, for example, from German Patent Document DE 30 18 682 A1. In the case of this known cooling system, an electric heating resistor, to which electric energy can be fed through a stationarily held working piston, is arranged in an expansion element of a thermostatic valve. The supply of the electric energy takes place via a control device in order to be able to maintain the coolant temperature controlled by the thermostatic valve constant better than in the case of a normal thermostatic valve. For this purpose, the actual coolant temperature is measured and is compared with a given upper and with a given lower temperature value. When the upper temperature value is reached, the heating resistor is supplied with electric energy so that the thermostatic valve opens up farther in order to reach an increased cooling capacity and therefore a lowering of the actual coolant temperature. If the actual coolant temperature then falls below the lower temperature value, the supply of electric energy to the heating resistor is interrupted so that the expansion element is cooled by the colder coolant. As a result, the valve cross-section is reduced again so that the actual coolant temperature rises again. These control steps are constantly repeated in order to maintain a coolant temperature in the range of, for example, 95° C. as constant as possible.

From German Patent Document DE 37 05 232 A1, a temperature control device is known in the case of which, instead of a conventional thermostatic valve with an expansion element, a valve is provided which can be controlled by means of a motor operator. In the case of this known temperature control device, for adjusting the valve, the motor operator is controlled as a function of a sensor which measures the coolant temperature in a pipe connected with the internal-combustion engine. In addition, the sensor is provided with a heating device. The heating device can be switched on and off as a function of characteristic-diagram quantities of the internal-combustion engine. Therefore, in the case of this known temperature control device, by heating the sensor, a higher than actual coolant temperature may be simulated in order to achieve an intensified cooling of the coolant. A temperature control device of this type requires high constructional expenditures and is therefore cost-intensive.

In German Patent Application P 43 24 178, which has not yet been published, a cooling system is also described for an internal-combustion engine of the initially mentioned type in the case of which the expansion element is designed such that the coolant temperature is adjusted to an upper limit temperature without any heating of the expansion element in the warm-up operation and/or in the mixed operation. In the case of this cooling system, a control unit is provided which, as a function of detected operational and/or environmental quantities of the internal-combustion engine, as required, releases the heating of the expansion element in order to shift the operating method of the cooling system from the warm-up operation or from the mixed operation of the upper operating limit temperature toward the mixed operation or cooling operation of a coolant temperature which is lower in comparison to the upper operating limit temperature. Since, in the case of this cooling system, the control of the expansion element of the thermostatic valve takes place as a function of detected operational and/or environmental quantities of the internal-combustion engine, an electronic control unit is required for controlling the heating of the expansion element in which the detected operational and/or environmental quantities of the internal-combustion engine are processed in a suitable manner and are used for controlling the heating of the expansion element.

It is an object of the invention to further develop a cooling system of the initially mentioned type in a manner that is as simple as possible such that, as a result, the operation of the internal-combustion engine can be optimized with respect to the fuel consumption and the exhaust gas values without any reduction of the power of the internal-combustion engine in the case of an increased power requirement.

This object is achieved by providing a cooling system for an internal-combustion engine of a motor vehicle comprising a radiator and a thermostatic valve by means of which the temperature of the coolant can be controlled in a warm-up operation, a mixed operation and a radiator operation, the thermostatic valve containing an expansion element which can be electrically heated for reducing the coolant temperature, wherein, as a result of the design of the expansion element, the coolant temperature is controlled without any heating of the expansion element in the mixed operation to an upper operating limit temperature, and wherein a temperature switch is provided which, as a function of the coolant temperature detected at the or near the radiator outlet, releases the heating of the expansion element as required in order to shift the method of operation of the cooling system toward the radiator operation.

As a result of the design of the expansion element, the coolant temperature is controlled without any heating of the expansion element in the mixed operation to an upper operating limit temperature and a temperature switch is provided which, as a function of the coolant temperature detected at the or near the radiator outlet, releases the heating of the expansion element as required in order to shift the method of operation of the cooling system toward the radiator operation.

The upper operating limit temperature is preferably equal to the operating temperature of the internal-combustion engine which is most favorable with respect to consumption and is slightly lower than the maximally permissible operating temperature of the internal-combustion engine. Preferably, the upper operating limit temperature is above 100° C., particularly at approximately 105° C. The maximally permissible operating temperature is the highest possible temperature at which the internal-combustion engine can be operated in the normal operation for an extended period of time without any disturbances. As a result, even if the electric heating of the expansion element fails, damage to the internal-combustion engine is avoided. Normally, the maximally permissible operating temperature is between 105° C. and 120° C.

If the expansion element is not heated electrically, an opening cross-section toward the radiator occurs exclusively as a function of the coolant temperature of the internal-combustion engine. This opening cross-section causes an adjusting of the coolant temperature to the defined upper operating limit temperature. In this case, the expansion element, for example, by selecting a corresponding temperature-dependent material and a suitable constructive development, is designed such that, at the defined upper operating limit temperature, the opening cross-section of the radiator is not yet maximal; that is, no pure radiator operation is achieved. Thus, by means of an additional heating of the expansion element, a further enlargement of the opening cross-section is possible and therefore a shifting in the direction of the radiator operation.

In a supplementary manner, it should be pointed out that the opening cross-section toward the radiator and the opening cross-section toward the short circuit by-passing the radiator are changed in opposite directions.

By means of the cooling system according to the invention, in the normal operation, that is, not when the power requirement is increased, as, for example, in the full-load operation of the internal-combustion engine or during uphill driving of the motor vehicle driven by the internal-combustion engine, an operating temperature of the internal-combustion engine is reached which is as high as possible. In this case, for example, as a result of lower friction, the power consumption of the internal-combustion engine is lower, whereby the fuel consumption can be lowered and the exhaust gas composition can be improved. However, in order to permit, when the operating condition of the internal-combustion engine requires a lower coolant temperature level because of an increased power demand, a rapid switchover to this coolant temperature level, a temperature switch is provided according to the invention which, as a function of the coolant temperature detected at the or near the radiator outlet, supplies electric energy to the heatable expansion element in such a manner that an increased cooling output is achieved by means of the further opening of the thermostatic valve and thus an increased coolant temperature is achieved in a rapid manner. Excessive coolant or internal-combustion engine temperatures in the case of an increased power requirement, would lead to a reduced volumetric efficiency and thus to a reduced power of the internal-combustion engine.

The advantage of the cooling system according to the invention in comparison to the cooling system in the not yet published German Patent Application P 43 24 178 is the fact that, as a function of different power requirements with respect to the internal-combustion engine, different coolant temperature levels can be achieved by means of a simple temperature switch while eliminating an electronic control unit which requires high technical expenditures and costs. Thus, the cooling system according to the invention is particularly suitable for an internal-combustion engine for motor vehicles of the lower price range. A further advantages of the cooling system according to the invention is the fact that the high-expenditures and cost-intensive detection of operational and environmental quantities of the internal-combustion engine will not be necessary.

The heating of the expansion element can be switched off again after a predetermined time, for example, in a time-controlled manner.

However, in the case of an advantageous further development of the invention, a two-position switch is provided as a temperature switch whose upper switching point is in the range of from 55° C. to 75° C., preferably at 65° C. and whose lower switching point is minimally 5° C. and maximally 50° C. below the upper switching point. In this further development of the invention, the heating device of the expansion element is switched off again when the coolant temperature detected at the or near the radiator outlet falls below the lower switching point of the two-position switch.

Other objects, advantages and novel features of the present invention will become apparent from the following detailed description of the invention when considered in conjunction with the accompanying drawings.

DETAILED DESCRIPTION OF THE DRAWINGS

Figure 1:
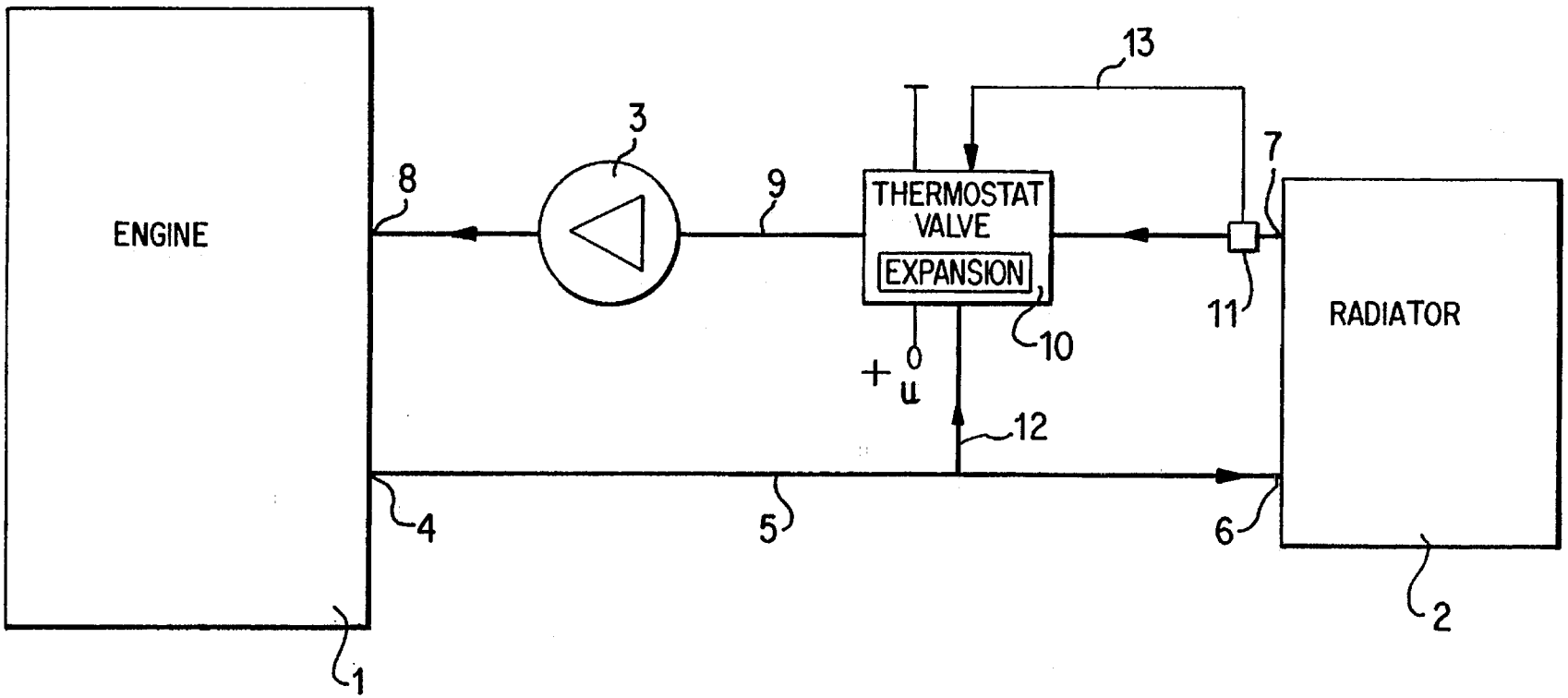
FIG. 1 is a schematic representation of a cooling system according to the invention for an internal-combustion engine.

The cooling system for an internal-combustion engine 1 illustrated in FIG. 1 comprises a radiator 2. Between the internal-combustion engine 1 and the radiator 2, a coolant pump 3 is arranged which generates a flow of the coolant in the direction illustrated by means of arrows. A forward flow pipe 5 to the coolant inlet 6 of the radiator 2 starts out from the coolant outlet 4 of the internal-combustion engine 1. A return flow pipe 9 leads from the coolant outlet 7 of the radiator 2 to the coolant inlet 8 of the internal-combustion engine 1. A thermostatic valve 10 with an expansion element not shown here is arranged in the return flow pipe 9. In addition, a temperature switch in the form of a two-position switch 11 is provided in the return flow pipe 9. The two-position switch 11 controls the heating device of the expansion element of the thermostatic valve 10 as a function of the coolant temperature detected at or near the radiator outlet 7 in that an electric heating voltage U is fed to a heating element of the expansion element of the thermostatic valve 10. In addition, the thermostatic valve 10 is connected with the forward flow pipe 5 by way of a short circuit pipe 12.

The cooling system operates essentially in three operating modes. In a first operating mode, the so-called warm-up operation, particularly after the cold start of the internal-combustion engine 1, the thermostatic valve 10 is adjusted such that the coolant flow coming from the internal-combustion engine 1 is led back by way of the short-circuit pipe 12 essentially completely to the internal-combustion engine 1. In a second operating mode, the cooling system works in the mixed operation; that is, the coolant coming from the internal-combustion engine 1 flows partially through the radiator 2 and partially by way of the short-circuit pipe 12, back to the internal-combustion engine 1. In a third operating mode, the cooling system works in the radiator operation; that is, the coolant coming from the internal-combustion engine 10 is returned essentially completely through the radiator 2 to the internal-combustion engine 1.

By means of the heating of the expansion element of the thermostatic valve 10 by the control by way of an electric line 13, by which the thermostatic valve 10 is electrically connected with the two-position switch 11, the method of operation of the cooling system can be adjusted in the direction of the radiator operation or can be completely switched over to the radiator operation. As a result, the temperature level of the coolant will be reduced in comparison to the temperature level reached by means of an operating mode without any heating of the expansion element. If then the heating of the expansion element of the thermostatic valve 10 is interrupted again by the control by means of the two-position switch 11 by way of the electric line 13, the now cooler coolant will cool down the expansion element of the thermostatic valve 10 until it takes up an adjusted end position in the mixed operation so that the coolant temperature is raised again to an end temperature. The adjusted end temperature in the mixed operation is set to the upper operating limit temperature.

The supply of the thermostatic valve 10 with electric energy is controlled by the two-position temperature switch 11 by way of the electric line 13 as a function of the coolant temperature detected at or near the radiator outlet 7. Since the cooling temperature at or near the radiator outlet 7 reflects the load condition of the internal-combustion engine 1 in a very good approximation, this coolant temperature at or near the radiator outlet 7 is very suitable-for controlling the heating of the expansion element of the thermostatic valve 10. This is the basis of the fact that the control of the heating of the expansion element of the thermostatic valve may take place in a constructively very simple and therefore very low-cost manner by means of a simple temperature switch, preferably a two-position temperature switch. It is therefore not necessary to detect different operational and/or environmental quantities of the internal-combustion engine 1 and to process them in an expensive electronic control unit for controlling the heating of the expansion element of the thermostatic valve 10.

Figure 2A:
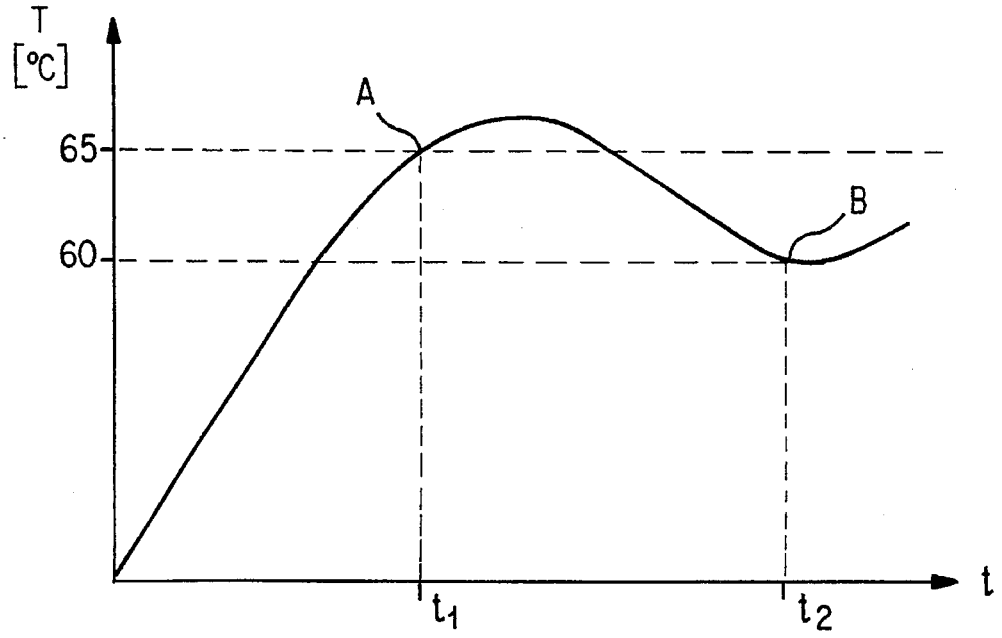
FIG. 2A is a graphical representation of a course of the coolant temperature at the outlet of the radiator of an internal-combustion engine obtained by means of the cooling system according to the invention.

FIG. 2A illustrates in a diagram the coolant temperature T above the time t in the case of a full load of the internal-combustion engine 1 (FIG. 1), which can be achieved by means of the cooling system according to the invention. The expansion element of the thermostatic valve 10 (FIG. 1) is designed, for example, by means of the composition of the expansion material, to an upper operating limit temperature which, in this case, corresponds, for example, to a cooling temperature of approximately 105° C. in the adjusted mixed operation. However, this coolant temperature of approximately 105° C. is achieved only in the partial-load operation in which it is expedient to reduce the fuel consumption by reducing friction and, at the same time, improve the exhaust gas composition. In principle, for optimizing consumption, the coolant temperature should always be as high as possible but, in the case of power demands in the full-load range, for improving the cylinder charge, should be as cool as possible.

The expansion element of the thermostatic valve 10 is designed such that, in this case, at approximately 105° C., the possible adjusting path of the thermostatic valve or the maximally possible opening cross-section is not yet adjusted. Thus, in the case of the full load of the internal-combustion engine, the expansion element of the thermostatic valve 10 (FIG. 1) can be heated such that, for a reduction of the coolant temperature that is as fast as possible, a maximal opening cross-section is adjusted in the direction of the radiator and, as a result, a complete change takes place to the radiator operation. In the case of the cooling system according to the invention, the full-load operation is detected by means of the temperature switch in the form of the two-position switch 11 (FIG. 1).

Figure 2B:
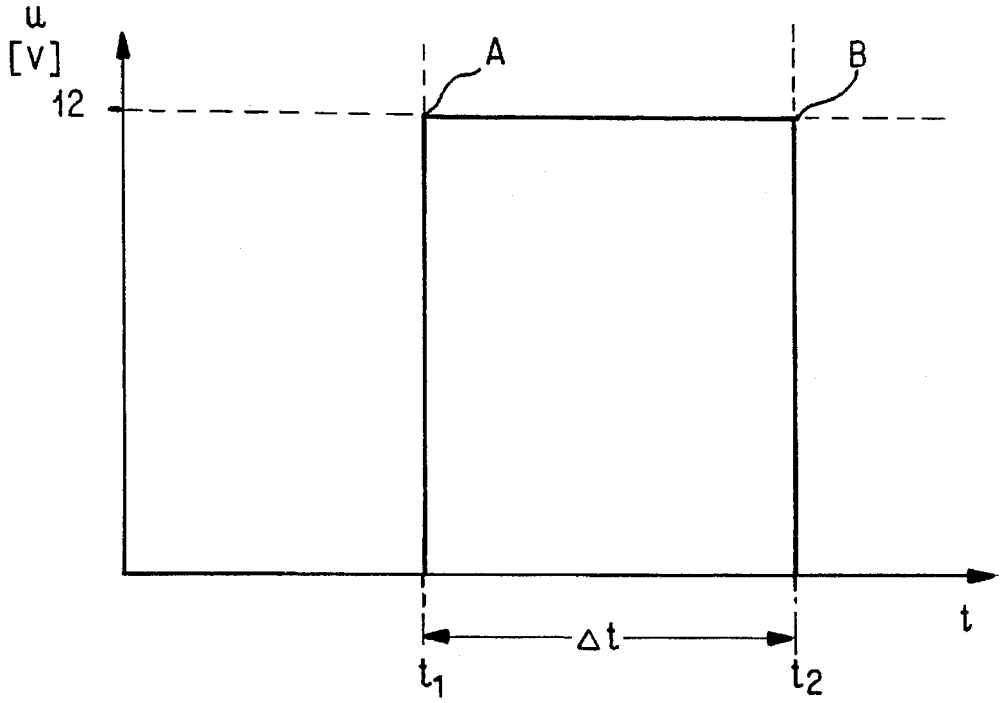
FIG. 2B is a graphical representation of the pertaining course of the heating voltage for the heating of the expansion element of the thermostatic valve of the cooling system according to the invention.

When, because of high stress to the internal-combustion engine, the coolant temperature at or near the radiator outlet 7 (FIG. 1), as indicated in FIG. 2A at Point A, exceeds the critical upper temperature threshold of 65° C. and thus the upper switching point, as indicated in FIG. 2B at the point in time $t_1$, for heating the expansion element of the thermostatic valve 10, the heating voltage U is fed to the heating element of the expansion element until the temperature of the coolant at or near the radiator outlet 7 (FIG. 1) has reached the lower temperature threshold of 60° C. (Point B) shown in FIG. 2A and thus the lower switching point of the temperature switch 11. Then, as indicated in FIG. 2B at the point in time $t_2$ (Point B), that is, after a time period $\Delta t$, the heating of the expansion element of the thermostatic valve 10 (FIG. 1) is interrupted again. This has the result that the coolant temperature at or near the radiator outlet 7 (FIG. 1) rises again slowly until the upper temperature threshold of 65° C. is reached again, and the point-in-time switch 11 (FIG. 1), when reaching its upper switching point, feeds the voltage U again to the heating element for heating the expansion element of the thermostatic valve 10 (FIG. 1).

The cooling system according to the invention is based on the recognition that the coolant temperature at the or near the outlet 7 of the radiator 2 represents in a very good approximation a measurement for the loading of the internal-combustion engine 1. In the case of the cooling system according to the invention, this recognition is utilized in that, at the or in the direct proximity of the outlet 7 of the radiator 2, a temperature switch is provided in the form of a two-point switch 11 which controls the load-dependent heating of the expansion element of the thermostatic valve 10 in the full-load operation of the internal-combustion engine 1. In the case of this simple type of control of the heating of the expansion element of the thermostatic valve 10, the cost-intensive detecting of the operational and environmental quantities of the internal-combustion engine 1 and also an expensive electronic control unit can be eliminated. The cooling system according to the invention is therefore particularly suitable for motor vehicles of the lower price range.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cooling system for an internal-combustion engine of a motor vehicle, comprising:

a radiator having a radiator outlet;

a thermostatic valve coupled to the radiator by means of which the temperature of the coolant is controlled in a warm-up operation, a mixed operation and a radiator operation, the thermostatic valve containing an expansion element which is electrically heated for reducing the coolant temperature by increasing an opening of the thermostatic valve;

wherein the thermostatic valve containing the expansion element is designed such that the coolant temperature is controlled without any heating of the expansion element in said mixed operation to an upper operating limit temperature; and a temperature switch coupled to the expansion element of the thermostatic valve, said temperature switch being switchable to directly signal the heating of the expansion element as required in order to shift the method of operation of the cooling system toward the radiator operation as a function of the coolant temperature detected at the or near the radiator outlet which approximates a load of the engine.

2. Cooling system according to claim 1, wherein the temperature switch is a two-position switch having an upper switching point in a range of from 55° C. to 75° C., and having a lower switching point of minimally 5° C. and maximally 50° C. below the upper switching point.

3. Cooling system according to claim 2, wherein said upper switching point is at approximately 65° C.

4. Cooling system for an internal-combustion engine of a motor vehicle, comprising:

a radiator having a radiator outlet;

a thermostatic valve coupled to the radiator by means of which the temperature of the coolant is controlled in a warm-up operation, a mixed operation and a radiator operation, the thermostatic valve containing an expansion element which is electrically heated for reducing the coolant temperature by increasing an opening of the thermostatic valve;

wherein the thermostatic valve containing the expansion element is designed such that the coolant temperature is controlled without any heating of the expansion element in said mixed operation to an upper operating limit temperature; and a temperature switch coupled to the expansion element of the thermostatic valve, said temperature switch being switchable to directly electrically heat the expansion element as required in order to shift the method of operation of the cooling system toward the radiator operation as a function of the coolant temperature detected at the or near the radiator outlet which approximates a load of the engine.

* * * * *